United States Patent [19]

Hostetter

[11] Patent Number: 4,626,467

[45] Date of Patent: Dec. 2, 1986

[54] BRANCHED POLYOLEFIN AS A QUENCH CONTROL AGENT FOR SPIN MELT COMPOSITIONS

[75] Inventor: Barry J. Hostetter, Decatur, Ga.

[73] Assignee: Hercules Incorporated, Wilmington, Del.

[21] Appl. No.: 809,369

[22] Filed: Dec. 16, 1985

[51] Int. Cl.[4] ..... D04H 1/58; D04H 1/04; D02G 3/00

[52] U.S. Cl. ..... 428/288; 428/296; 428/364; 526/348.2

[58] Field of Search ..... 526/348.2; 428/288, 428/296, 364

[56] References Cited

U.S. PATENT DOCUMENTS

| | | | |
|---|---|---|---|
| 4,113,704 | 9/1978 | MacLean et al. | 528/289 |
| 4,359,561 | 11/1982 | Fraser et al. | 526/348.2 |
| 4,525,257 | 6/1985 | Kurtz | 522/161 |

*Primary Examiner*—James J. Bell
*Attorney, Agent, or Firm*—John E. Crowe

[57] ABSTRACT

A method for minimizing air-quench dependency and improving tolerance to high speed spinning of polyolefin spin melt compositions by incorporating an active amount of polyolefin additive having a Branching Index of about 0.20–0.90; plus corresponding spin melt composition and yarn product.

23 Claims, No Drawings

BRANCHED POLYOLEFIN AS A QUENCH CONTROL AGENT FOR SPIN MELT COMPOSITIONS

This invention relates to a method for minimizing air-quench dependency and avoiding inherent limitations of air-quenching techniques as presently applied to linear base polyolefin spin melt compositions, whereby one may increase spinning speed beyond that currently possible using normal air quench rates by incorporating an active amount of branched polyolefin additives into the spin melt. The resulting spun product is more efficiently produced and exhibits substantial improvement in fiber quality and thermal bonding characteristics.

BACKGROUND

The production of multi-filament feed yarns from polymeric fiber-formers such as polyesters and linear polypropylene, through the use of spin melt techniques, is well-known in the art. Such techniques have been refined over the years by various design and component changes, permitting increased post spinning draw down. Substantial improvements with respect to spinning speed itself, however, appear to be limited by process dependency upon the existence of an efficient damage-free filament-quenching or cooling step. In effect, fast moving soft extruded filaments must be given sufficient strength and flexibility to withstand the substantial amount of take up stress common to modern high speed spinning techniques and equipment.

In general, air-quenching is preferred for such high speed production because of the fragile nature of most spun filaments, however, it is very difficult to assure an acceptable degree of quench for all filaments within large, multi-rowed filament bundles.

By way of example, a large spinnerette using a jet of quenching air at room temperature and flowing at a speed of about 100–600 ft/minute perpendicularly across the extruded filament bundle normally causes the rows of extruded filaments closest to the air jet to be more quickly cooled than geometrically more distant rows. The net result is a tendency to over-quench close filaments with increased risk of filament breakage attributed to cohesive or brittle fracture, while distant filaments tend to remain under-quenched, with increased risk of ductile failure during high speed take up.

As production spinnerette units have become larger, and operate at rates in excess of 1500 M/m, the above problems become acute, such that filaments close to the air jet must be exposed to the maximum allowable quench while distant filaments must be given a minimally acceptable quench. In short, any inadvertent changes in air temperature, spinning speed, post spinning draw down velocity, or melt temperature is very likely to result in failure of a substantial number of filaments within the fiber bundle.

While some progress as been made in avoiding brittle fracture by increasing post spinning filament draw down of high denier spun polyester filaments, including branched polyesters (ref. U.S. Pat. No. 4,113,704), such teaching does not solve or even directly address itself to the abovenoted limits imposed due to inefficiency of the air quenching step.

It is an object of the present invention to increase efficiency and flexibility of air-quench-dependent spin melt compositions for spinning processes.

It is a further object of the instant invention to improve continuity and maximize high speed spinning strength of polyolefin-containing melts, and a still further object of the present invention to obtain high speed spinning of multicomponent polyolefin-containing spin melts for producing good quality low melting fiber webs suitable for producing nonwoven material.

THE INVENTION

It is now found that the above objects, particularly increasing efficiency and flexibility of air-quench-dependent spin melt compositions can be achieved by incorporating within the compositions, an active amount of at least one branched polyolefin additive having a Branching Index within the range of about 0.20–0.90.

For purposes of the present invention, the term "spin melt composition" comprises at least one linear base polymer of one or more extrudable polypropylene, polyethylene, or polyester, inclusive of extrudable resins. Preferably such composition shall have sufficient plasticity to permit high speed extrusion through standard production spinnerettes having up to about 2,600 holes or more, to form large filament bundles.

The term "an active amount" is here defined as the amount of branched polyolefin additive present at a concentration of about 0.5%–90% by weight based on total spin melt, the optimal amount of branched polyolefin additive being substantially determined by (1) the degree of additive branching as measured by the Branching Index, (2) the molecular weight of the additive, (3) the molecular weight of the linear polymer base, (4) the spinning speed and (5) the temperature of the melt.

In general, it is preferred to spin multi-filament low melt temperature polyolefin spin melt compositions within the scope of the present invention at a production rate up to and exceeding about 2400 Meters/minute (M/m) by incorporating into the melt an active amount of the long chain branched additive, usefully about 1%–20% by weight, and preferably about 1%–10% by weight.

Linear base material found useful for purposes of the present invention are generally extrudable linear fiber formers, particularly polyolefin fiber formers, which face substantial risk of filament failure when operating at high speed spinning rates, particularly within the range of about 1500 M/m–3000 M/m in large melt spinning devices containing up to and in excess of about 2600 holes per spinnerette.

Base material for use within the present invention preferably includes linear polyolefins such as polyethylene and polypropylene resins(*1) having weight average molecular weights within a range of about $5\times10^4$ to $5\times10^5$, and melt indices within the range of about 0.1 to 50.0.

*1—Commercially available, for instance, from Himont Incorporated under the trademarks Profax® 6301, 6501, 6801 and from E I DuPont Inc. under the trademark Alathon® 7840.

Corresponding branched additives, for purposes of the present invention, usefully vary from a weight average molecular weight of about Mw 150,000–1,000,000 and usefully have about 1–100 or more side chain terminal methyl groups, the preferred Mw value for present purposes being about 150,000–400,000.

The general relation of the amount of radiation dosage-to-Branching Index, and the correlation between Branching Index and required concentration of branched polyolefin additive in the melt is further demonstrated in Table I.

TABLE I

| Branched Polyolefin Additive*2 (% by wt. Melt) | 0.5%–10% | 10%–20% | 20%–90% |
|---|---|---|---|
| Branching Index (an) | 0.20–0.40 | 0.40–0.60 | 0.60–0.90 |
| Branching Category | H*3 | M*4 | L*5 |

*2Linear base polypropylene resin obtained commercially from Himont Incorporated under the mark Profax 6501 is irradiated within 1–10 Mrad in general accordance with techniques described in Marans and Zapas, JAPS Vol. II, pg. 705–718 (1967) as low level irradiation in accordance with U.S. Pat. No. 4,525,257 of Kurtz et al; or obtained commercially from E I DuPont under the trademark Alathon ® 1540

*3H = high degree of branching.

*4M = medium degree of branching

*5L = low degree of branching.

The term "Branching Index", (supra) is further defined by the formula:

$$B.I. = IV_1/IV_2$$

in which "$IV_1$" represents the intrinsic viscosity of the branched additive and "$IV_2$" represents the intrinsic viscosity of a corresponding linear base of the same molecular weight.

For purposes of the present invention, the melt temperature of the combined base and additive and corresponding extruder zone can usefully vary from about 185° C.–310° C. and preferably fall within the range of about 245° C.–290° C., depending upon the particular base polymer, the amount of branched additive, and its Branching Index.

Preparation-wise linear base component is conveniently visbroken and pelletized before blending with an active amount of desired branched additive (optionally in similar form) by tumble mixing and re-extrusion or similar combining techniques known to the art. Such additive, for purposes of the instant invention, can be used singly or in admixture, and can include commercially obtainable low density cross-linked polyolefins such as polyethylene(*6), or conveniently obtained on a noncommercial basis by irradiation and cross-linkage of available linear polyolefins, using art-recognized beam irradiation techniques. Such techniques usually employ about 1–10 Mrad to obtain a Branching Index within the range of about 0.2–0.9.

*6A—Commercially available from E I DuPont under the mark Alathon ® 1540

Various other additives known to the art can also be incorporated into spin melt compositions as desired. These include for instance, antioxidants, such as commercially obtained Cyanox ® 1790; degrading agents such as commercially obtained from the Penwalt Corporation as Lupersol ® 101; pigments and art-known whiteners and colorants such as $TiO_2$; and pH-stabilizing agents known to the art such as calcium stearate.

Such additives are usefully included in a concentration of 1% or less, although higher concentrations can be used as desired up to about 10% by weight of melt or more.

The present invention is further illustrated, but not limited by the following examples:

EXAMPLE I

Polypropylene spin melt compositions identified as samples S-1 through S-15 are prepared by tumble mixing pellets of linear polypropylene (Profax 6301) respectively with 1%, 5%, 10% and 20% by weight of corresponding branched polypropylene additives individually obtained in accordance with the Marans and Zapas article cited supra(*2) by irradiating a corresponding linear base. The resulting polypropylene branched additives are conveniently classified as high "(H)", medium "(M)" or low "(L)" in general accordance with the Branching Indices as set out in Table I (supra).

*2—Linear base polypropylene resin obtained commercially from Himont Incorporated under the mark Profax 6501 is irradiated within 1–10 Mrad in general accordance with techniques described in Marans and Zapas, JAPS Vol. II, pg. 705–718 (1967) as low level irradiation in accordance with U.S. Pat. No. 4,525,257 of Kurtz et al; or obtained commercially from E I DuPont under the trademark Alathon ® 1540.

Each branched additive plus Cyanox 1790 antioxidant (0.06% by weight), calcium stearate stabilizer (0.1%) and a polymer degredant (0.025%), are then tumble mixed with a pelletized commercially obtained linear base polymer, double extruded and spun at 245° C., using a standard monofilament spinnerette at a take up rate of 500 M/m. Test results are reported in Table II below.

TABLE II

| Sample # | Additive Branch Evaluation* Concentration (% by weight) | Spin Tension (Grams) | Die Swell | Denier % CV |
|---|---|---|---|---|
| S-1*7 | 0 | 0.32 | 1.54 | 19.7 |
| S-2 | L-1% | 0.24 | 1.54 | 11.5 |
| S-3 | L-5% | 0.22 | 1.55 | 10.6 |
| S-4 | L-10% | 0.22 | 1.55 | 8.3 |
| S-5 | L-20% | 0.30 | 1.56 | 10.4 |
| S-6 | M-1% | 0.27 | 1.55 | 15.0 |
| S-7 | M-2% | 0.26 | 1.53 | 11.4 |
| S-8 | M-5% | 0.25 | 1.55 | 13.2 |
| S-9 | M-10% | 0.26 | 1.55 | 10.2 |
| S-10 | M-20% | 0.33 | 1.58 | 8.0 |
| S-11 | H-1% | 0.27 | 1.53 | 17.0 |
| S-12 | H-2% | 0.31 | 1.52 | 11.5 |
| S-13 | H-5% | 0.42 | 1.50 | 10.2 |
| S-14 | H-10% | 0.55 | 1.43 | 17.6 |
| S-15 | H-20% | (Would Not Spin) | | |

*7(Control)

EXAMPLE II

Eighteen samples of the linear polypropylene base of Example I, identified as S-16 through S-33, are admixed and re-extruded with 1%, 2%, 5%, 10% and 20% by weight of high (H), medium (M) and low (L) branched polypropylene additive, and prepared in the manner reported in Example I by tumbling and re-extrusion. The resulting spin melts are spun at 245° C., using the same air-quench temperature and flow rates as used in Example 1.

Spun filaments are monitored respectively at 3, 9, and 11 cm distances from the spinnerette during spinning operation, using a standard laser micrometer(*8) and the respective elongational viscosities determined and reported in Table III.

*8—Model 60, Techmet Co. of Dayton, Ohio.

TABLE III

| Sample | Branched Polypropylene Additive (% by wt) | Additive Branching Evaluations | Apparent Elongational Viscosity $\times 10^{-4}$ (Poise)*9 (H) | (M) | (L) | Distance From Jet (cm) |
|---|---|---|---|---|---|---|
| S-16 | 0 (Control) | | | 9.3 | | 3 |
| S-17 | 0 (Control) | | | 10.7 | | 9 |
| S-18 | 0 (Control) | | | 11.2 | | 11 |
| S-19 | 1% | H,M,L | 10, | 10.3 | 9.5 | 3 |
| S-20 | 1% | H,M,L | 15, | 12.2, | 11.5 | 9 |
| S-21 | 1% | H,M,L | 17, | 13.0, | 11.8 | 11 |
| S-22 | 2% | H,M,L | 12.0, | 11.0, | — | 3 |
| S-23 | 2% | H,M,L | 19.0, | 15.5, | — | 9 |

TABLE III-continued

| Sample | Branched Polypropylene Additive (% by wt) | Additive Branching Evaluations | Apparent Elongational Viscosity $\times 10^{-4}$ (Poise)*9 (H) | (M) | (L) | Distance From Jet (cm) |
|---|---|---|---|---|---|---|
| S-24 | 2%. | H,M,L | 21.5, | 17.0, | — | 11 |
| S-25 | 5% | H,M,L | 14.0, | 12.2, | 12.8 | 3 |
| S-26 | 5% | H,M,L | 25.3, | 17.0, | 16.2 | 9 |
| S-27 | 5% | H,M,L | 29.2, | 18.5, | 17.5 | 11 |
| S-28 | 10% | H,M,L | 22.0, | 11.5, | 11.2 | 3 |
| S-29 | 10% | H,M,L | —, | 17.0, | 12.9 | 9 |
| S-30 | 10% | H,M,L | —, | 19.0, | 13.5 | 11 |
| S-31 | 20% | H,M,L | —, | 16.2, | 10.0 | 3 |
| S-32 | 20% | H,M,L | —, | 25.8, | 15.0 | 9 |
| S-33 | 20% | H,M,L | —, | 28.3, | 16.5 | 11 |

*9Calculated from the formulae $$V_z = \frac{Q}{47.124\,\rho\,D^2}$$

$$\dot{E} = \frac{dV_z}{d_z} = \frac{V_{z2} - V_{z1}}{Z_2 - Z_1}$$

$$\eta E = \frac{1249\ ST}{D^2 \frac{dV_z}{d_z}}$$

$V_z$ = Fiber Velocity (cm/sec.)
Q = Throughput Rate (gm/Min.)
$\rho$ = Density (gm/ml)
D = Diameter of Filament (cm)
$\dot{E}$ = Elongation Rate ($sec^{-1}$)
ST = Spin Tension (gm)
$\eta E$ = Apparent Elongational Viscosity

TABLE IV

| Sample | % PE | Extruder Zone Temp. (°C.) | Extrusion | Jet Pressure (PSI) | Spin Tension (grams) 500 M/m | 900 M/m | 1500 M/m | 2400 M/m | Filament Denier | Denier CV (%) |
|---|---|---|---|---|---|---|---|---|---|---|
| S-34 | 0 | 245 | Single | 245 | .220 | .241 | .342 | .490 | 20.4 | 13.3 |
| S-35 | 1 | 245 | Single | 240 | .233 | .324 | .476 | .523 | 19.2 | 9.9 |
| S-36 | 1 | 245 | Double | 242 | .230 | — | .247 | *14 | — | — |
| S-37 | 2 | 245 | Single | 248 | .261 | .322 | .292 | .310 | 19.5 | 9.3 |
| S-38 | 2 | 245 | Double | 252 | .254 | — | .366 | .578 | 19.7 | 13.0 |
| S-39 | 5 | 245 | Single | 127 | .331 | — | *13 | — | 20.4 | 40.5 |
| S-40 | 5 | 245 | Double | 256 | .458 | — | *13 | — | 19.7 | 46.9 |
| S-41 | 5 | 245 | Co-extrusion | 241 | .279 | .359 | .452 | .540 | 19.6 | 19.4 |
| S-42 | 10 | 245 | Single | *14 | — | *14 | — | — | — | — |
| S-43 | 20 | 245 | Single | *14 | — | *14 | — | — | — | — |

*13Unstable spinning.
*14Would not spin.

EXAMPLE III

Mixed polypropylene/polyethylene spin melt compositions identified as S-34 through S-43 are prepared in the manner of Example I by tumble mixing pelleted Profax 6501 visbroken to 23 MFR with 1%, 2%, 5%, 10% and 20% by weight of branched polyethylene obtained as Alathon 1540, with re-extrusion to obtain desired melt compositions. The respective melts are spun at 500, 900, 1500 and 2400 M/m, using the test spinnerette of Example 1 and test results reported in Table IV.

EXAMPLE IV

Mixed linear and branched polyethylene polymers obtained commercially from E I DuPont as Alathon 7840 and 1540 respectively, are pelletized, tumble mixed, re-extruded using medium branched additives (M) at concentrations within the range of 0–20%, based on weight of melt, and spun as in Example I to obtain spin tension test results comparable to those obtained in Example III.

EXAMPLE V

Staple fiber samples S-5 and S-11 of Example I and S-35 and S-38 of Example III are individually spun using the same test spinnerette as Example I (1.5 denier 1.5" cut). The fibers are carded and laid to form webs weighing about 12–15 g/yd$^2$ and lightly thermally bonded using a diamond pattern callender (140° C. 40 psi) to obtain nonwoven test material exhibiting satisfactory bulk, feel and dry tensile strength.(*10)

*10—Instron Test Instrument, using 5" gauge length and 2"/minute crosshead speed.

EXAMPLE VI

Nonwoven material obtained from Example V is cut into 12" test ribbons and fed into the garniture of a standard filter rod-making apparatus(*11), maintaining a velocity differential of about 20% between the ribbon feed rate and the rod-making apparatus feed belt, to obtain fiber rods and 90 mm fiber tips exhibiting satisfactory crush and draw characteristics.(*12)

*11—Model UK5 manufactured by the Molins Company of London, England.
*12—Using a Filtrona Harkness Resilience Tester, (Mark V Series) manufactured by Abbey Mfg., Ltd., Wimbly, England.

What I claim and desire to protect by Letters Patent is:

1. A method for increasing efficiency and flexibility of an air-quench-dependent spin melt compositions, comprising incorporating within said spin melt compositions an active amount of at least one branched polyolefin additive having a Branching Index within the range of about 0.20–0.90.

2. The method of claim 1 wherein spin melt composition comprises at least one linear base polymer selected from the group consisting of extrudable polypropylene, polyethylene, polyester and extrudable resin.

3. The method of claim 2 wherein the branched polyolefin additive is present at a concentration of about 0.5%–90% by weight based on total spin melt.

4. The method of claim 3 wherein long chain branched polyolefin additive is added in a concentration of about 1%–20% by weight.

5. The method of claim 4 wherein the branched polyolefin additive is a polypropylene or a polyethylene, having a branching index of about 0.20–0.40 and present in a concentration of about 1%–10% by weight.

6. The method of claim 4 wherein the branched polyolefin additive is a polypropylene or a polyethylene, having a branching index of about 0.40–0.60 and is present in a concentration of about 10%–20% by weight.

7. The method of claim 4 wherein the branched polyolefin additive is a polypropylene or a polyethylene having a branching index of about 0.60–0.90 and is present in a concentration of about 20%–90% by weight.

8. The method of claim 1 wherein the branched polyolefin additive has a weight average molecular weight of about 150,000–1,000,000.

9. The method of claim 4 wherein the branched polyolefin additive has a weight average molecular weight of about 150,000–400,000.

10. A polyolefin spin melt composition comprising at least one linear base polyolefin and an active amount of at least one branched chain polyolefin additive having a Branching Index of about 0.20–0.90 and a weight average molecular weight of about 150,000–1,000,000.

11. The spin melt composition of claim 10 wherein the branched chain polyolefin additive has a weight average molecular weight of about 150,000–400,000.

12. The spin melt composition of claim 10 wherein the linear base polyolefin component is a polypropylene or a polyethylene and the branched chain polyolefin additive is a polypropylene or a polyethylene having a branching index of from about 0.20–0.40, and present in a concentration of about 0.5%–10% by weight.

13. The spin melt composition of claim 10 wherein the linear base polyolefin component is a polypropylene or a polyethylene and the branched chain polyolefin is a polypropylene or a polyethylene, having a branching index of from about 0.40–0.60, and is present in a concentration of about 10%–20% by weight.

14. The spin melt composition of claim 10 wherein the linear base polyolefin component is a polypropylene or a polyethylene and the branched chain polyolefin is a polypropylene or polyethylene having a branching index of from about 0.60–0.90, and is present in a concentration of about 20%–90% by weight.

15. Polyolefin filament yarn obtained in accordance with the method of claim 1.

16. Polyolefin yarn obtained in accordance with the method of claim 2.

17. Polyolefin yarn obtained in accordance with the method of claim 3.

18. Polyolefin yarn obtained in accordance with the method of claim 4.

19. Polyolefin yarn obtained in accordance with the method of claim 8.

20. Nonwoven fabric utilizing a web comprising of the polyolefin of claim 15.

21. Nonwoven fabric utilizing a low temperature web comprising the polyolefin of claim 16.

22. Nonwoven fabric utilizing as thermal binder a low temperature web comprising the polyolefin of claim 18.

23. Nonwoven fabric utilizing as thermal binder a low temperature web comprising the polyolefin of claim 19.

* * * * *

UNITED STATES PATENT AND TRADEMARK OFFICE

CERTIFICATE OF CORRECTION

PATENT NO. : 4,626,467

DATED : December 2, 1986

INVENTOR(S) : Barry J. Hostetter

It is certified that error appears in the above-identified patent and that said Letters Patent are hereby corrected as shown below:

Column 1, line 64 "abovenoted"

should read --above-noted--.

Column 2, line 66 "doas"

should read --dos--.

Signed and Sealed this

Thirty-first Day of March, 1987

*Attest:*

DONALD J. QUIGG

*Attesting Officer*

*Commissioner of Patents and Trademarks*